United States Patent [19]

Fisk et al.

[11] 4,185,742

[45] Jan. 29, 1980

[54] COIL COVER

[75] Inventors: Dwight Fisk, Appleton; Willis P. Drew, Green Bay, both of Wis.

[73] Assignee: Straubel Paper Company, Green Bay, Wis.

[21] Appl. No.: 948,567

[22] Filed: Oct. 4, 1978

[51] Int. Cl.[2] ..... B65D 85/66

[52] U.S. Cl. ..... 206/414; 206/811; 206/813

[58] Field of Search ..... 206/413–416, 206/811, 813; 242/68.6

[56] References Cited

U.S. PATENT DOCUMENTS

| | | | |
|---|---|---|---|
| 1,772,850 | 8/1930 | Wheldon | 206/414 |
| 3,590,991 | 7/1971 | Sloan | 206/413 |
| 3,895,711 | 7/1975 | Hiltunen et al. | 206/413 |
| 3,942,638 | 3/1976 | Stone | 206/416 |

FOREIGN PATENT DOCUMENTS

| | | | |
|---|---|---|---|
| 243453 | 11/1925 | United Kingdom | 206/414 |

OTHER PUBLICATIONS

"Package for Tin Mill Coils–Eye Vertical", Designation RL 78–488–1;14–D–519(019–1).

*Primary Examiner*—Steven E. Lipman

*Attorney, Agent, or Firm*—Hills, Van Santen Steadman, Chiara & Simpson

[57] ABSTRACT

A water-proof cap to protect the ends of rolled sheet stock has an outer chip board cover, an inner chip board cover, and a cylindrical skirt of creped kraft paper the top of which is sandwiched between the periphery of the inner and outer layers of chip board. A water-proof adhesive provides a circumferential seal between the edge of the skirt and the inner and the outer chip board layers. Polyethylene film laminated to an inner surface of the skirt and to one surface of one of the chip board covers further enhances the water resistant characteristics of the cover.

Covers have also been constructed using corrugated board, liner board and heavy kraft paper in place of the chip board described above.

9 Claims, 3 Drawing Figures

COIL COVER

BACKGROUND OF THE INVENTION

1. Field of the Invention

The invention relates to the field of covers for packaging coils of sheet stock such as aluminum, steel or tin plate. The covers are placed over the ends of the rolls.

2. Description of the Prior Art

Coil covers or bags placed over the ends of coils of aluminum, steel or tin plate have been in use for many years. The prior art covers have been made of a variety of papers and paper laminations. The prior art coil covers have all been fabricated by sewing. The major weakness of sewing is that the preforations in the paper allow water to pass through. There has been a need for a coil cover which would be more resistant to the passage of water than was the case with the prior art covers.

SUMMARY OF THE INVENTION

The invention comprises a water-proof cap to be placed over the ends of rolled sheet stock for protection from the environment. The cover has an outer chip board layer which is circular having a diameter slightly larger than the diameter of the roll to be covered. A skirt of creped kraft paper having a polyethylene film backing has a cylindrical shape and extends down the roll from the outer circular and cover. A second chip board layer having substantially the diameter of the roll to be covered cooperates with the outer chip board layer to clamp the top end of the skirt therebetween. The circumferential joint between the outer chip board cover, the top of the skirt, and the inner chip board cover is sealed with a water-proof adhesive.

The circular cover thus constructed, has an outer circular end cap which fits over the end of the roll to be protected with a skirt extending down the roll a predetermined distance to further minimize the exposure of the end of the roll to moisture. A sheet of polyethylene film may be applied to either the outer cover or the inner cover. Alternately, the chip board may be treated with a water-proof coating thereby rendering the layer of polyethylene film unnecessary. The chip board (or other material) may be treated with a chemical or chemicals designed to retard or prevent corrosion of the metal in the coil.

The skirt has a bend in the end which joins the two chip boards. This bend of 90° forms a shoulder with the inner and outer surfaces of the skirt being essentially parallel to the inner and outer discs.

DETAILED DESCRIPTION OF THE PREFERRED EMBODIMENTS

Figure 1:
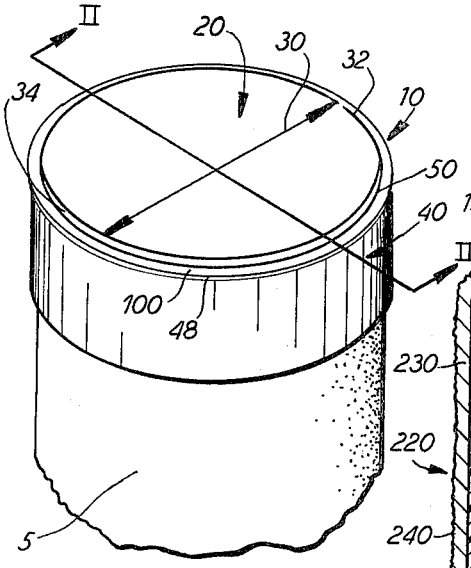
FIG. 1 is a perspective view of the cover of the present invention positioned over the end of a roll of sheet stock.

While the principles of the present invention find a utility in a coil cover for covering the ends of coils of aluminum, steel or similar rolled materials, it will be understood that the coil cover of the present invention may be used in other combinations. By way of disclosing the best mode, and not by way of limitation, there is shown generally in FIG. 1 a perspective view of a coil 5 having a coil cover 10 embodying the principles of the present invention. The coil cover 10 has an outer disc 20 of chip board material with a diameter 30 selected to be somewhat larger than the diameter of the coil 5 over which the cover 10 is to be placed. The disc 20 has an outer surface 32, an inner parallel surface 33 and a circular edge 34 perpendicular to the surfaces 32 and 33. Bonded to the perimeter of the chip board disc 20 is a cylindrical skirt 40 composed of creped kraft paper backed by a polyethylene film. A circumferential joint 50 between the disc 20 and the skirt 40 is sealed with a water-proof adhesive in order that the end of the roll will stay dry.

Figure 2:
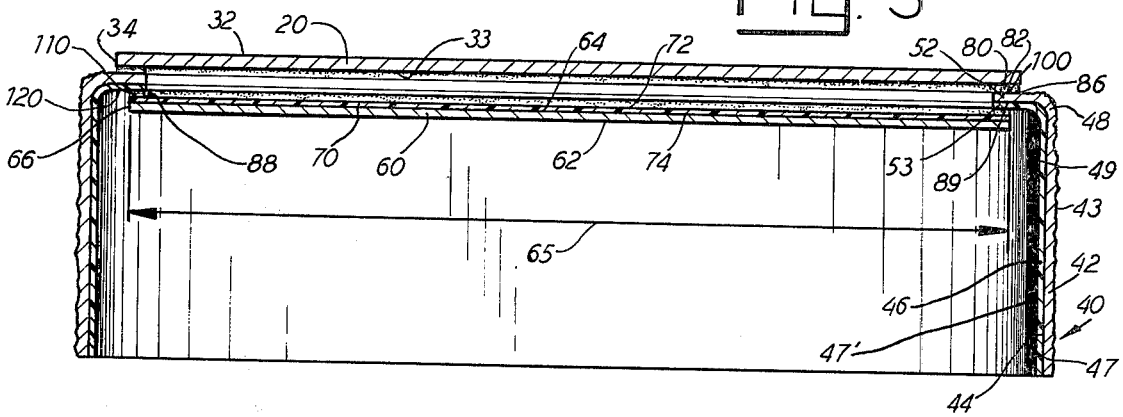
FIG. 2 is a section taken along line II—II of FIG. 1 showing the construction of the cover of the present invention.

FIG. 2, a section taken along line II—II of FIG. 1, discloses the internal structure of the cover 10. The skirt 40 has an external layer of creped kraft paper 42. The paper layer 42 has an external surface 43 and a parallel internal surface 44. A layer of polyethylene film 46 has a first surface 47 and a second surface 47'. The surface 47 of the polyethylene film 46 is bonded or laminated to the surface 44 of the external paper layer 42. The outer layer 42 of the skirt 40 has a shoulder 48 near the joint 50. In the same region, the layer of polyethylene film 46 has a shoulder 49. The shoulders 48, 49 result in the skirt 40 having a regions 52, 53 generally perpendicular to the outer layer 42 and the inner polyethylene layer 46.

An inner chip board disc 60 has a diameter 65 which is slightly smaller than the diameter 30 of the outer disc 20 but is still large enough to fit over the end of the roll 5. The inner chip board disc 60 has a first surface 62, a second parallel surface 64 and a circular edge 66 perpendicular to the surfaces 62, 64. A layer of polyethylene film 70 has a first surface 72 and a second parallel surface 74. The film 70 is bonded to the disc 60 along the adjacent surfaces 74, 76. The layers of film 70 and 46 improve the water resistant characteristics of the cover 10.

The outer disc 20, the inner disc 60 and the regions 52, 53 of the skirt 40 are all bonded together by beads of water-proof adhesive. A bead of adhesive 80 is disposed between a peripheral region 82 of the surface 33 of the disc 20 and a surface 86 of the region 52 of the outer layer 42 of the skirt 40. A secon bead 110 of water-proof adhesive is disposed between a peripheral region 88 of the surface 72 of the film 70 and a peripheral surface 89 of the region 53 of the skirt 40. A typical water-proof adhesive that might be used to form the beads 80 and 110 is a hot melt type adhesive. The beads 80, 11 each form a closed circle co-extensive with the edges 34, 66 of the discs 20, 60.

Figure 3:
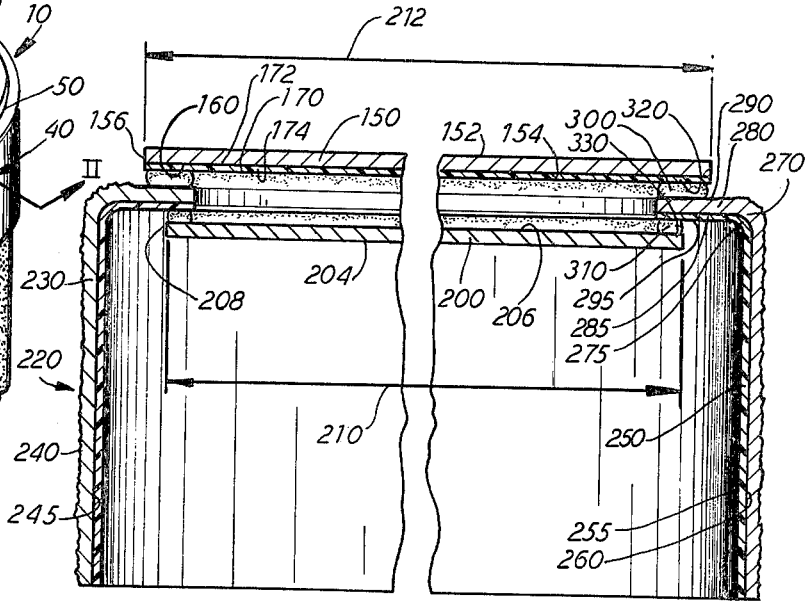
FIG. 3 is a section corresponding to the section taken along line II—II of FIG. 1 showing an alternate construction of the cover of the present invention.

FIG. 3 discloses an alternate embodiment of the invention. In FIG. 3, an exterior chip board disc 150 has a first surface 152 parallel to a second surface 154 with an edge 156 perpendicular to both surfaces 152, 154. A layer of polyethylene film 170 has a first and a second surface 172, 174. The film 170 is bonded to the disc along the surface 154 of the disc 150 and the surface 172 of the layer film 170.

An interior disc 200 has a first surface 204 and a parallel second surface 206. An edge 208 of the disc 200 is perpendicular to the surfaces 204 and 206. The disc 200 has a diameter 210 which is somewhat smaller than a diameter 212 of the exterior disc 150. A skirt 220 has an exterior layer 230 composed of crepe kraft paper. The exterior layer 230 has a first exterior surface 240 and a second interior surface 245. A layer of polyethylene 250 has a first surface 255 and a second surface 260. The layer of polyethylene 250 is laminated to the exterior layer of kraft paper 230 along the adjacent surfaces 260 and 245. the external layer of kraft paper 230 has a shoulder 270 formed in one end thereof. In the same region the interior laminated layer of polyethylene film 250 has a shoulder 275. The shoulders 270 and 275 join the external layer 230 and the associated layer of polyethylene film 250 to a region 280 and a region 285 each of which are perpendicular to the surface 260 or the surface 245 of the external layer 230 and the laminated polyethylene film 250. The region 280 has a surface 290 and the region 285 has a surface 295 parallel to the surface 290. The surfaces 290 and 295 are essentially parallel to the surfaces 174 and 206 of the exterior disc 150 and the interior disc 200.

A bead of water-proof cement 300 seals the surface 174 of the layer of polyethylene film 170 to the surface 290 of the region 280. A second bead of water-proof cement 310 seals the surface 295 of the region 285 to the surface 206 of the disc 200. The beads of cement 300 and 310 are applied along a periphery 320 and a periphery 330 of the surface 174 and the surface 295. A water-proof adhesive of the hot melt variety is used to form the circumferential beads 300 and 310.

It should be noted that the external surfaces 43 and 240 of the kraft paper layers 42 and 230 are roughened surfaces for the prevention of abrasion and for improved durability.

When assembled, the cover 10 as disclosed in FIG. 2 or FIG. 3 is then placed over the end of the roll of aluminum, steel or other such coiled material for protection thereof.

The main reason for the creped outer paper 42 of the skirt 40 is to provide stretch in the skirt 40 so that it is easily pulled over the end of the coil of sheet stock 5. The outer layer of paper 42 over the layer of polyethylene film 46 in the skirt 40 is to protect the film 46 from abrasion.

The diameter 30 of the outer disk 20 may equal the diameter 65 of the inner disc 60 if desired.

Although various modifications might be suggested by those skilled in the art, it should be understood that I wish to embody within the scope of the patent warranted hereon all such modifications as reasonably and properly come within the scope of may contribution to the art.

I claim as my invention:

1. A coil cover for covering the end of a cylindrical roll of sheet material comprising:

a two-part cylindrical skirt of a selected height and interior diameter having an exterior layer of a first unstretched paper sheet material bonded to an interior layer of plastic film, an interior disk of a selected sheet stock having a selected diameter;

an exterior disk of a selected sheet stock having a diameter a selected amount greater than said diameter of said interior disk and a selected amount smaller than said interior diameter of said two-part skirt;

each said disk being treated so as to be resistant to the passage of moisture therethrough;

a circumferential region of a first end of said two-part cylindrical skirt being formed substantially perpendicular to said skirt and extending inwardly with respect thereto;

a circumferential region of an inner planar surface of said exterior disk being sealingly bonded to an external region of said inwardly extending circumferential region of said first end of said two-part skirt;

a circumferential region of an outer planar surface of said interior disk being sealingly bonded to an internal region of said inwardly extending circumferential region of said first end of said two-part skirt;

said outer, water resistant, disk, said inner, water resistant disk, said two-part skirt and said sealing bonds therebetween forming a unitary, water resistant, coil cover slidable onto the end of the coil to be covered.

2. A coil cover for covering the end of a cylindrical roll of sheet material comprising:

a two-part cylindrical skirt of a selected height having an exterior circumferential layer of a first selected unstretched paper sheet material bonded to an interior circumferential layer of plastic film, an interior diameter of said two-part skirt being a selected amount larger than the exterior diameter of the roll to be covered;

a two-part end-cap disk having a first disk-shaped layer comprised of a second selected sheet material, with a selected diameter a selected amount less than said interior diameter of said two-part skirt; said first disk-shaped sheet stock layer being bonded to a second disk-shaped layer of plastic film having substantially said selected diameter;

a circumferential region of said plastic disk-shaped layer of said two-part disk being sealingly bonded to a circumferential first end region of said interior plastic film layer of said two-part skirt with said two-part disk being oriented substantially perpendicular to a center of rotation of said two-part skirt;

said two-part skirt, said two-part disk and said sealing bond forming a unitary water-proof end cover slidable onto the end of the roll of material to be covered with said two-part skirt extending axially along the roll a selected distance.

3. The coil cover according to claim 2 wherein said first selected, unstretched, sheet material forming said outer layer of said two-part skirt comprises unstretched, creped kraft paper of a selected weight having a roughened surface for the prevention of abrasion and for improved durability.

4. The coil cover, according to claim 3, wherein said second selected sheet material forming said first disk-shaped layer of said two-part disk comprises chipboard of a selected weight.

5. The coil cover, according to claim 3, wherein said first end region of said interior plastic film layer of said two-part skirt comprises an end region oriented inwardly with respect to said skirt and substantially perpendicular thereto.

6. The coil cover, according to claim 5, having further a second disk of a selected material, with a diameter a selected amount larger than said diameter of said first two-part disk and a selected amount smaller than said interior diameter of said two-part skirt; a circumferential region, on a first planar surface of said second disk, being sealingly bonded to a circumferential end region of said exterior creped kraft paper layer of said two-part skirt in spaced apart relationship to said first disk and substantially parallel thereto.

7. A coil cover comprising:

a first and second disk of sheet stock of a selected weight, said first disk having a diameter a selected amount greater than a diameter of said second disk, a layer of plastic film bonded at a first planar surface to a first planar surface of said first disk and having a diameter substantially equal to said diameter of said first disk;

a two-part cylindrical skirt having an outer cylindrical layer of a selected unstretched paper and an inner cylindrical layer of plastic film bonded to an inner surface of said outer paper layer, said two-part skirt having a predetermined height and an interior diameter a selected amount larger than said diameter of said first disk, the periphery of a second planar surface of said layer of plastic of said first two-part disk being adhesively affixed, by means of a water-proof adhesive, to a circumferential region of a first end of said exterior paper layer of said two-part skirt;

the periphery of a first planar surface of said second disk being adhesively affixed, by means of a water-proof adhesive, to a circumferential region of said first end of said interior plastic layer of said two-part skirt, said two-part skirt, said first two-part disk said second disk, and said adhesive bonds therebetween forming a unitized water-proof coil cover slidable onto the end of the coil of sheet material to be covered, with said two-part skirt extending axially along the coil to be covered and with said disks being oriented substantially parallel to the end of the coil to be covered.

8. The coil cover according to claim 7 wherein said skirt has a shoulder near said first end which orients such first end such that said first and second planar surfaces of said first end are substantially parallel to said planar surfaces of said first and second disks.

9. A coil cover for covering the end of a cylindrical roll of sheet material comprising:

a cylindrical skirt being formed of unstretched creped material with the selected circumference of said sheet of unstretched creped kraft material a selected amount larger than the perimeter of the cylindrical roll to be covered and having a height selected to cover an axial portion of the roll;

a flexible plastic sheet member of a selected thickness having a length substantially the same as the circumference of the skirt and a height substantially the same as the height of the skirt and being bonded at a first planar surface to an interior surface of said creped kraft skirt to form a two-part cylindrical water-proof skirt with said plastic sheet member forming an interior wall, said two-part skirt having an interior diameter a selected amount larger than the diameter of the coil to be covered such that said two-part skirt will slide over the exposed, outer, cylindrical surface of the roll to be covered;

an inner disk of a selected sheet material having a layer of plastic bonded to a first planar surface of said disk thereby forming a two-part disk-shaped water-proof end cover for the coil to be covered;

said two-part inner disk having a diameter a selected amount larger than the diameter of the coil to be covered;

an outer disk of a selected sheet material having a selected diameter;

a first end of said two-part skirt being formed with an inwardly oriented tab, at substantially a right angle, to said two-part skirt, said circumferential tab having an outer surface of said unstretched creped kraft paper and an inner surface of said plastic film;

a circumferential region of said inner plastic surface of said tab being bonded, by water-proof adhesive, to a circumferential region of a first plastic, planar, surface of said two-part inner disk thereby forming a water-proof coil cover;

a circumferential region of said outer surface of said tab being bonded, by water-proof adhesive, to a circumferential region of a first surface of said outer disk to sealingly close the coil cover.

* * * * *